10/16/84 OR 4,477,815

United States Patent [19]

Brunner et al.

[11] Patent Number: 4,477,815

[45] Date of Patent: Oct. 16, 1984

[54] RADOME FOR GENERATING CIRCULAR POLARIZED ELECTROMAGNETIC WAVES

[75] Inventors: Anton Brunner, Wangen; Klaus Rieskamp, Soecking, both of Fed. Rep. of Germany

[73] Assignee: Siemens Aktiengesellschaft, Berlin & Munich, Fed. Rep. of Germany

[21] Appl. No.: 281,314

[22] Filed: Jul. 8, 1981

[30] Foreign Application Priority Data

Jul. 17, 1980 [DE] Fed. Rep. of Germany ..... 3027093

[51] Int. Cl.[3] ..... H01Q 15/24

[52] U.S. Cl. ..... 343/756; 343/872

[58] Field of Search ..... 343/756, 909, 872

[56] References Cited

U.S. PATENT DOCUMENTS

| | | | |
|---|---|---|---|
| 2,970,312 | 1/1961 | Smith | 343/756 |
| 3,754,271 | 8/1973 | Epis | 343/909 |
| 3,961,333 | 6/1976 | Purinton | 343/872 |
| 3,972,043 | 7/1976 | Locus | 343/756 |

*Primary Examiner*—Eli Lieberman

*Attorney, Agent, or Firm*—Hill, Van Santen, Steadman & Simpson

[57] ABSTRACT

Means for re-polarizing and generating circularly polarized waves using a single or multi-layer lattice structure which is placed in front of a radiation aperture with the lattice structure consisting of a plurality of conductors extending in the form of lines which meander and might be rectangular combinations or the like. With a lattice, a polarization conversion into circular polarization and the suppression of orthogonal polarization components is simultaneously achieved by providing that the meandering lines 4 extend in a direction such that the meander lines have an angle of 45° at every location with respect to the respective E vectors of the linearly polarized E-vector fields at such locations. The re-polarization means can be used as a Radome of a target tracking radar antenna.

5 Claims, 4 Drawing Figures

RADOME FOR GENERATING CIRCULAR POLARIZED ELECTROMAGNETIC WAVES

BACKGROUND OF THE INVENTION

1. Field of the Invention

This invention relates generally to re-polarization means for generating circularly polarized electromagnetic waves.

2. Description of the Prior Art

Primary radiators, as for example, for search and target tracking radar antennas usually have linear polarization. However, the use of circular polarization is desirable in radar applications so as to reduce reflection effects of rain clouds and thus the linear polarization of the antenna is frequently converted by a lattice structure placed in front of the antenna aperture so as to obtain circular polarization. Such polarization converters using lattice structures are known as, for example, as shown in U.S. Pat. No. 3,754,271. This patent discloses meander lines which extend at 45° to the E-vector which is the electrical field vector of the instant wave and they generate a phase difference due to the capacitive or inductive influence of the E-vector components which lie perpendicular and parallel to the meander lines and a phase difference of 90° is necessary for this circular polarization and this is achieved with suitable dimensioning and layering.

Other types of lattice structures consist of straight lines at specific intervals in a plurality of layers as well as line and rectangular combinations for generating circular polarization. The suppression or decoupling of the cross-polarization or in general of the orthogonal or de-polarization with respect to a desired linear or circular polarization is of great importance in many applications. For example, so as to avoid cross-talk utilizing double polarization operation or in order to achieve the necessary precision in position finding methods. For this purpose, lattices with metal strips or wires extend perpendicular with respect to the E-vector can be employed in a known manner with linear polarization. The cross-polarization component which extends parallel to the wires is reflected and is thus suppressed. By using a plurality of such lattice layers, the degree of suppression of the cross-polarization components can be further accomplished.

SUMMARY OF THE INVENTION

The present invention relates to a re-polarization means for generating circular polarized electromagnetic waves which uses a composite layer of multi-layer lattice structures mounted in front of a radiation structure with a lattice structure consisting of a plurality of conductors which extend in the form of lines such as meander lines of line and rectangular combinations wherein at all positions, the lines extend in a direction which is 45° to the respective E-vectors at a respective position.

The object of the invention is to convert the given polarization of an antenna into a circular polarization using a single lattice arrangement so that the varying cross-polarization components existing across the antenna aperture will be suppressed during the conversion or the resulting polarization consisting of co-polarization and cross-polarization will be converted into the desired polarization. The two objects of polarization conversion and orthogonal polarization suppression are accomplished in one step for the present invention wherein in prior devices two separate means were utilized to accomplish the conversion and the suppression.

According to the invention, which comprises a re-polarization device as mentioned above, the meander lines which may be of line and rectangular combinations or the like, are oriented with respect to the direction of their primary direction such that they have an angle of 45° at every location relative to the respective E-vectors at the particular location of the linearly polarized E-vector field of the incident wave which is to be re-polarized. Generally, the incident field is known or can be easily determined. After calculation or measurement of the field, the aperture of polarization distribution is determined and the direction of the conductors at each particular point can be specified.

The inventive principle of the invention can be applied both to a planar polarization lattice as well as to a curved conical shape lattice for example when the orientation of the conductor structure is related to the projection in one plane perpendicular to the primary radiation axis which is the antenna axis.

In an advantageous manner, the conductors of the lattice structures may be etched metal strips mounted on synthetic foil.

When using multi-layer lattice structure, layers of insulating material are mounted between the individual foils for the purpose of spacing and said layers of insulating material can consist of rigid expanded polyurethane or may also be designed as a honeycomb structure.

The re-polarization device according to the invention can be combined in an expedient manner to form an aperture or cover such as a Radome of an antenna for example of a target tracking antenna.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure and in which:

DESCRIPTION OF THE PREFERRED EMBODIMENTS

Figure 1:
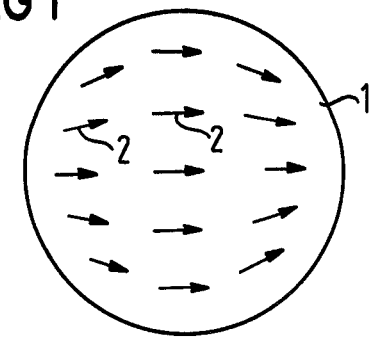
FIG. 1 is a plan view illustrating a E-vector field across the aperture of a parabolic reflector antenna.

FIG. 1 illustrates the E-vector distribution of the electromagnetic radiation from a parabolic reflector antenna and comprises a plan view. The arrows 2 indicate the direction of the E-vectors at the particular locations in the aperture 1. The vector distribution which illustrates the polarization distribution can be calculated or measured.

In the present invention, the direction of the polarization vectors 2 at each location in the antenna aperture 1 is measured or calculated so as to obtain this information which can be recorded or plotted as illustrated in FIG. 1.

Figure 2:
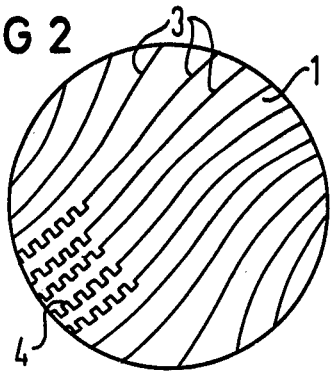
FIG. 2 illustrates the direction of the conductor structure of a lattice-like re-polarization device according to the invention.

FIG. 2 illustrates the aperture 1 with a metal lattice structure 3 mounted in front of it which generates the desired circular polarization from the polarizations illustrated in FIG. 1. The conductors 4 are meandering conductors as illustrated in detail at the lower left of FIG. 2 and they have an orientation which is inclined at 45° with respect to the respective E-vectors 2 at all of the corresponding locations of the E-vectors in FIG. 1. In other words, if the fifteen E-vectors 2 illustrated in FIG. 1 are known to exist at particular locations then the conductors 3 can be located in the aperture by assuring that the conductors 3 are at 45° to the vectors 2 at each particular location. This results that all of the E-vectors over the aperture 1 independent of their inclination are converted into desired circular polarization without a counter rotating orthogonal component being generated when the metal lattice structure of conductors illustrated in FIG. 2 is used. In order to simplify the drawing, the meander form of the conductors 4 is illustrated only in a small range of the aperture 1, but it is to be realized that the conductors 3 illustrated in FIG. 2 actually are meander conductors as indicated in detail by numeral 4.

Figure 3:
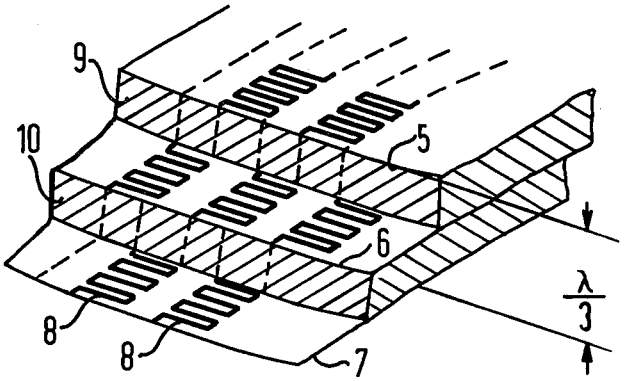
FIG. 3 is a partially cut-away sectional view of the device according to FIG. 3 executed in three layers.

FIG. 3 is a section of a polarization lattice according to the invention which uses three metal lattice structures one placed above the other which are attached to synthetic plastic foils 5, 6 and 7 respectively. The conductors 8 are formed on each of the foils 5, 6 and 7 as illustrated in FIG. 3 by etching for example. Each of the three lattice structures on the foils 5, 6 and 7 comprise a plurality of meander shape tracks 8. In a plan view, the tracks 8 applied to the foil 6 extend approximately parallel to each other in a small range. The tracks 8 formed on the foil 6 are oriented so that they fall between the tracks 8 on the foils 5 and 7 as illustrated. In other words, the tracks 8 on the foil 6 are formed in the spacing between the tracks 8 on the foils 5 and 7 when looking down in a plan view.

So as to provide specific spacing between the foils 5, 6 and 7, layers 9 and 10 of insulating material are mounted between the foils. The layers of insulating material can be honeycomb structure which advantageously saves a substantial amount of weight in the construction. The thickness of the overall lattice sandwich is one-third wave length as is illustrated in FIG. 3. Thus, the distance from the foil 7 to the foil 5 is one-third of a wave length.

Figure 4:
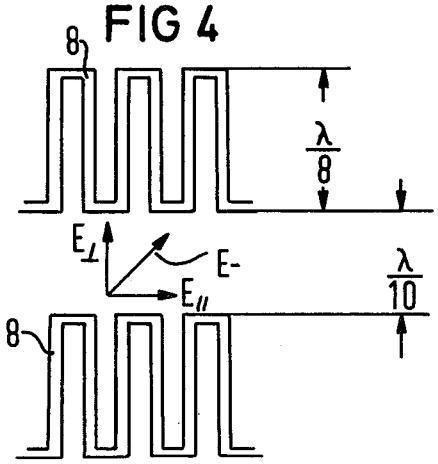
FIG. 4 is a plan view illustrating a pair of meander-like conductors.

FIG. 4 comprises a plan view of two tracks 8 formed on a foil which extend approximately parallel to each other over a short range with respect to a direction which is 45° to the E-vector instant wave existing at that location. The meander-shaped tracks 8 have an amplitude transverse to their longitudinal direction of one-eighth wave length as illustrated and the spacing between adjacent tracks is one-tenth of a wave length as illustrated.

Although the invention has been described with respect to preferred embodiments, it is not to be so limited as changes and modifications can be made which are within the full intended scope of the invention as defined by the appended claims.

We claim as our invention:

1. A re-polarization device for generating circularly polarized electro-magnetic waves by using a layered lattice structure which respectively consists of a plurality of conductors extending in the form of meander lines, of line rectangle combinations which are mounted in front of a radiation aperture of a parabolic mirror which radiates signals with E-vectors which are not parallel to each other and are distorted across the surface and said radiation comprising linearly polarized electro-magnetic waves which have cross-polarization components over the aperture which are not parallel to each other characterized in that the longitudinal direction of said meander lines (4) of the lattice structure (3) mounted in front of the radiation aperture (1) are at all locations oriented such that they extend in longitudinal directions which are inclined at 45° relative to the E-vector (2) at each location of the E-vector field of the incident wave to be re-polarized so as to convert said E-vector field into circular polarization, characterized that said polarization device is used as an aperture cover of a parabolic antenna, and characterized in that the antenna is a target tracking radar antenna with a covered reflector mirror and the lattice structure is contained in the reflector aperture covering.

2. A re-polarization device according to claim 1, characterized in that the meander conductors (4) are etched metal strips (8) attached to a synthetic foil (5, 6, 7).

3. A re-polarization device according to claim 2, characterized with a multi-layer lattice structure, spacing layers of insulating material (9, 10) are mounted between the foils (5, 6, 7) with said layers of insulating material consisting of rigid expanded polyurethane.

4. A re-polarization device according to claim 2, characterized for a curved, non-planar lattice structure, the position of the meander line/rectangle lines (4) is determined by projecting on one plane perpendicular to the primary radiation axis.

5. A re-polarization device according to claim 2, characterized with a multi-layer lattice structure, spacing layers of insulating material (9, 10) are mounted between the foils (5, 6, 7) with said layers of insulating material being designed as a honeycomb structure.

* * * * *